United States Patent [19]

Chen

[11] Patent Number: 4,587,679

[45] Date of Patent: May 13, 1986

[54] TOILET FLUSHING DEVICE

[76] Inventor: Chin-Lin Chen, No. 74, Lane 40, Ta-Hsing Street, Tainan, Taiwan

[21] Appl. No.: 678,458

[22] Filed: Dec. 5, 1984

[51] Int. Cl.[4] ..... E03D 1/34

[52] U.S. Cl. ..... 4/388; 4/360

[58] Field of Search ..... 4/387, 388, 379, 380, 4/327, 395, 415, 420, 360

[56] References Cited

U.S. PATENT DOCUMENTS

| | | | |
|---|---|---|---|
| 317,055 | 5/1885 | Weeden | 4/388 |
| 399,690 | 3/1889 | Newell | 4/388 |
| 3,820,171 | 6/1974 | Larson | 4/360 |
| 4,138,749 | 2/1979 | Clark | 4/388 |
| 4,412,362 | 11/1983 | Nylund | 4/388 |

*Primary Examiner*—Stephen Marcus
*Assistant Examiner*—L. J. Peters
*Attorney, Agent, or Firm*—Christie, Parker & Hale

[57] ABSTRACT

A flushing device controllable for discharging a desired amount of water after use of a toilet is provided with a cylinder supported within the tank, a piston slidable in the cylinder and divides the inner space thereof into an upper chamber and a lower chamber with variable volumes, on the piston there are provided with through holes for communicating these two chambers, and a flexible baffle member is attached to the bottom surface of the piston and capable of admitting the water to flow from the upper chamber into the lower chamber. A piston rod is connected to the piston and terminates in a stopper positioned in alignment with the flushing pipe, by means of a compression spring mounted with respect to the piston rod between the cylinder and the stopper, the stopper is normally biassed against the flushing pipe until a pull of the piston which forces the stopper moved away from the discharging pipe against the biassing of the spring and so that initiates the flushing, a lower chamber filled with water having a volume corresponding to the piston displacement is caused in the movement of the piston, the piston and the stopper is therefore prevented from lowering until the compression predominates over the buoyance of water received in the lower chamber.

3 Claims, 5 Drawing Figures

TOILET FLUSHING DEVICE

BACKGROUND OF THE INVENTION

This invention relates to a toilet and particularly it concerns the improvements of a flushing device of the water closet. This invention is provided for overcoming several disadvantages existing with a conventional water closet as shown in FIG. 1 and FIG. 2, for example, when the lever 17 is pressed and then released, the water in the tank 10 continues to flow until the tank 10 is drained. The lever 17 is connected with a freely movable float 21 through an arm 22, the float 21 is prevented from floating to the surface of the water. When the chain 19 is raised it then pulls the pivotably movable cover 13 and the discharge rubber seal 12 attached to the cover 13 away from the discharging end 111, the discharging end 111 of the flush pipe thus is opened, the cover 13 is engaged with a recess 161 of the controlling element 161 so as to be maintained in a opened position. When the water in the tank 10 lowers to a level which is not sufficient to support the float 15, the float 15 descends and the cover 13 is disengaged with the recess 161, therefore, the discharging end 111 is sealed off by the rubber seal 12 once again. However, there are some disadvantages existing with this type of flushing system. Firstly, the water flow generally may not be completly stopped until the cistern achieves a full water level, this is because the valve disc is held in a closed position by the water pressure exerted thereon, once the pressure is released, the inflowing water will push the valve disc upward which makes clearence between the valve disc and its seat.

Further, each time the toilet is flushed, the amount of the flushing water consumed is almost constant, once the handle 17 is pressed and the valve disc lifted, the water in the cistern 10 has to be exhausted before the valve disc 12 closes again, therefore, the amount of flushing water can not be controlled to a desired degree.

In this conventional type of water closet, because there is not provided with the means for holding the discharge cover 13 and the rubber seal 12 tightly on its seat, therefore, sometimes a clearence will be formed therebetween which causes leakage.

SUMMARY OF THE INVENTION

With the above disadvantages in view, the primary object of the invention is to provide an improved flusing device for the toilet.

It is another object of the invention to provide a flushing device in which each time the toilet is flushed, it can be controlled as desired.

This invention is of simple construction and can be operated easily. Appropriate water discharge quantities can be simply controlled by the degree in which the operating lever is pressed which may be determined by the user's judgement.

In the best mode of this invention, a flush control device for the tank of a toilet, including an inlet pipe and at the top thereof fitted with a flush valve the operation of which is controlled by a float, an operating lever having a portion protruding outwardly of the tank and connected with a linking member having an end operatably secured with a discharge cover seated over a discharging pipe, the improvement comprises: a cylinder connected with the linking member, including an opened upper end disposed intermediated at the high water level and the low water level of the tank, and abottom wall provided with an opening; a piston is slidable in the cylinder and driving the space within the cylinder into an upper chamber and a lower chamber having varible volumns with the sliding thereof, and is provided with axial through holes for communicating the upper and lower chamber; a baffle means mounted beneath the piston and flexing oppositely to the piston as the psiton is pulled upwardly against the water pressure and the water in the upper chamber thus is admitted to the lower chamber, but limiting such flow in the opposite direction; a piston rod having an end passing through the opening of the cylinder to connect with the piston, the discharge cover being mounted on the opposite end of the piston rod for sealing off the discharging pipe; a compression spring mounted on the piston rod and biassing the discharge cover away from the cylinder, when the discharge cover is pulled away from the discharging pipe against the biassing of the compression spring, the water held in the tank will flush through the flushing pipe, when the water pressure in the cylinder is lowered to a certain level, the compression spring returns to its biassing position and biasses the discharge cover tightly against the discharging pipe once again.

BRIEF DESCRIPTION OF THE DRAWINGS

The presently preferred exemplary embodiment will be described in detail with respect to the following drawings, wherein.

DETAILED DESCRIPTION OF THE PREFERRED EMBODIMENT

Figure 1:
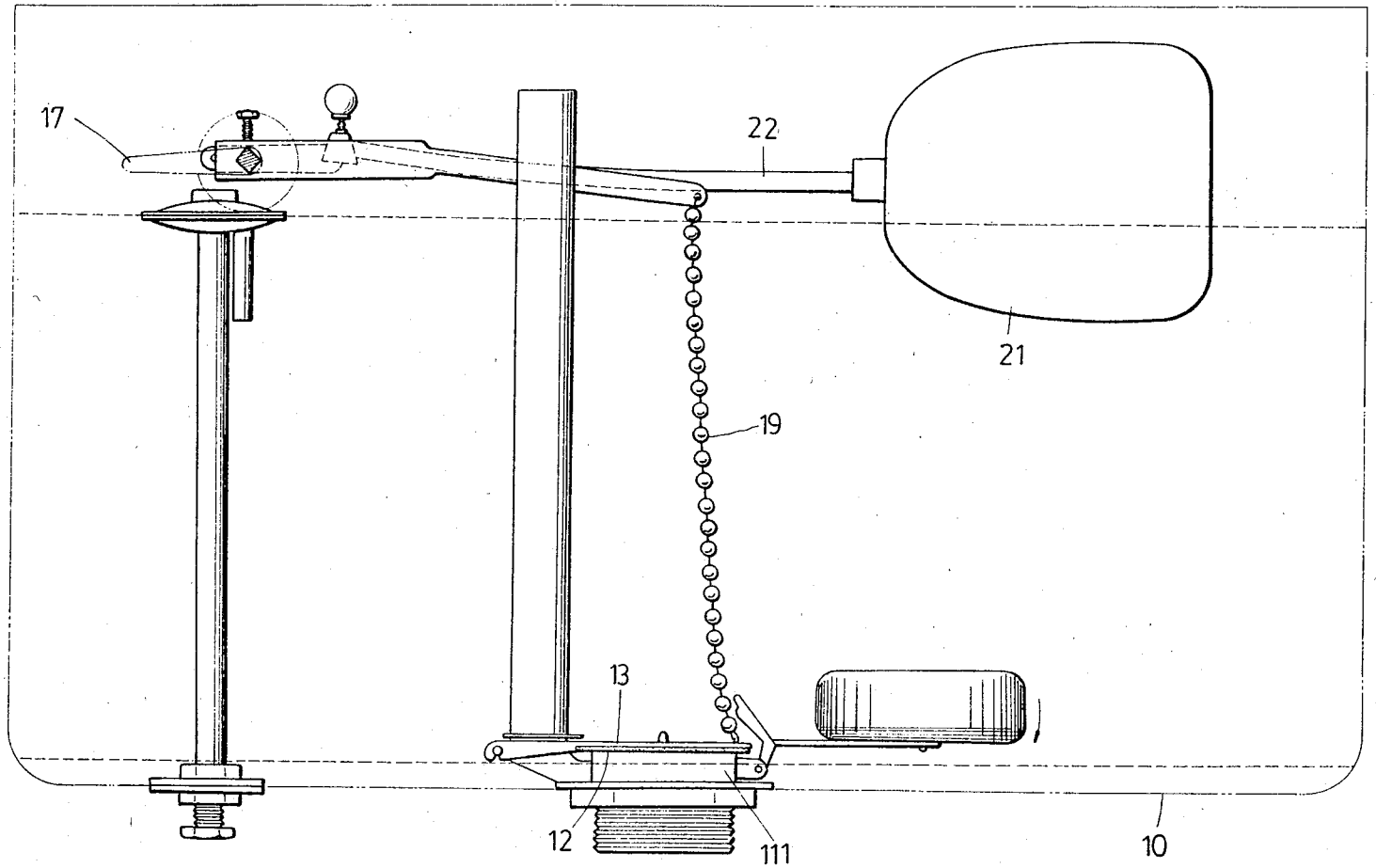
FIG. 1 is a side view of a conventional water closet.
Figure 2:
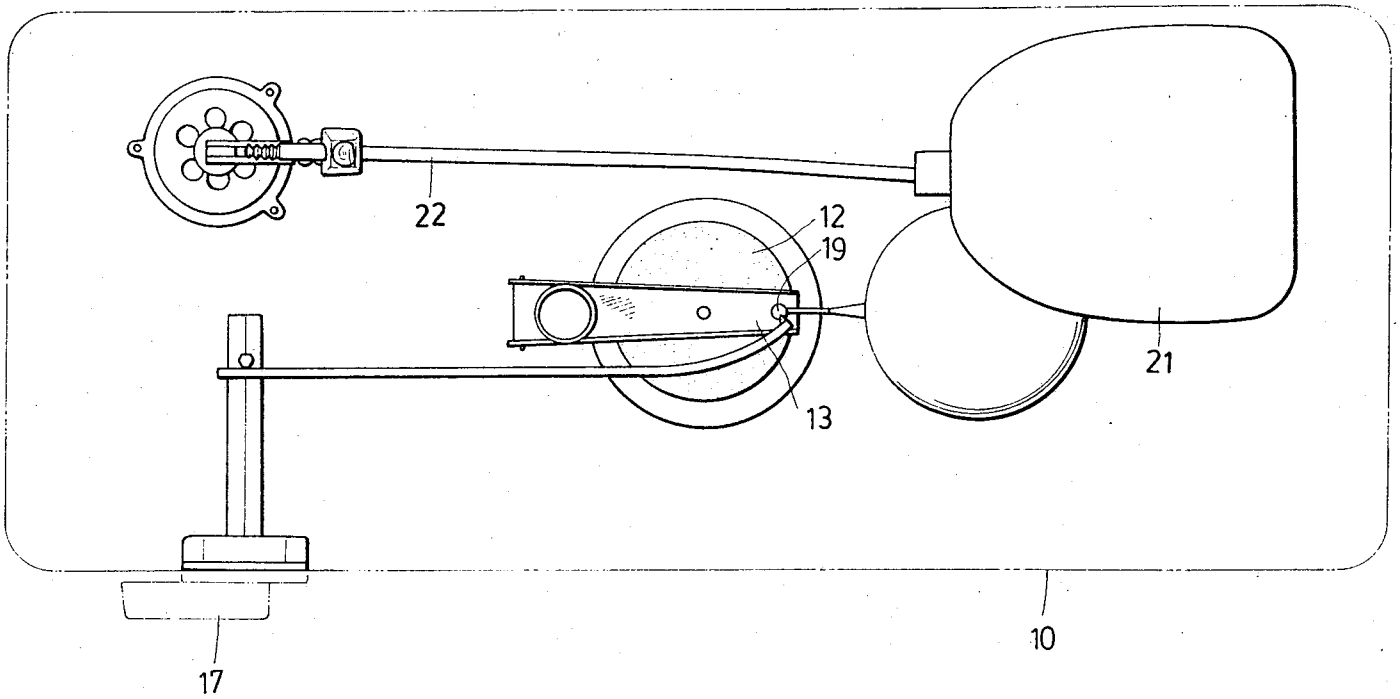
FIG. 2 is a top view of a conventional water closet as shown in FIG. 1.
Figure 3:
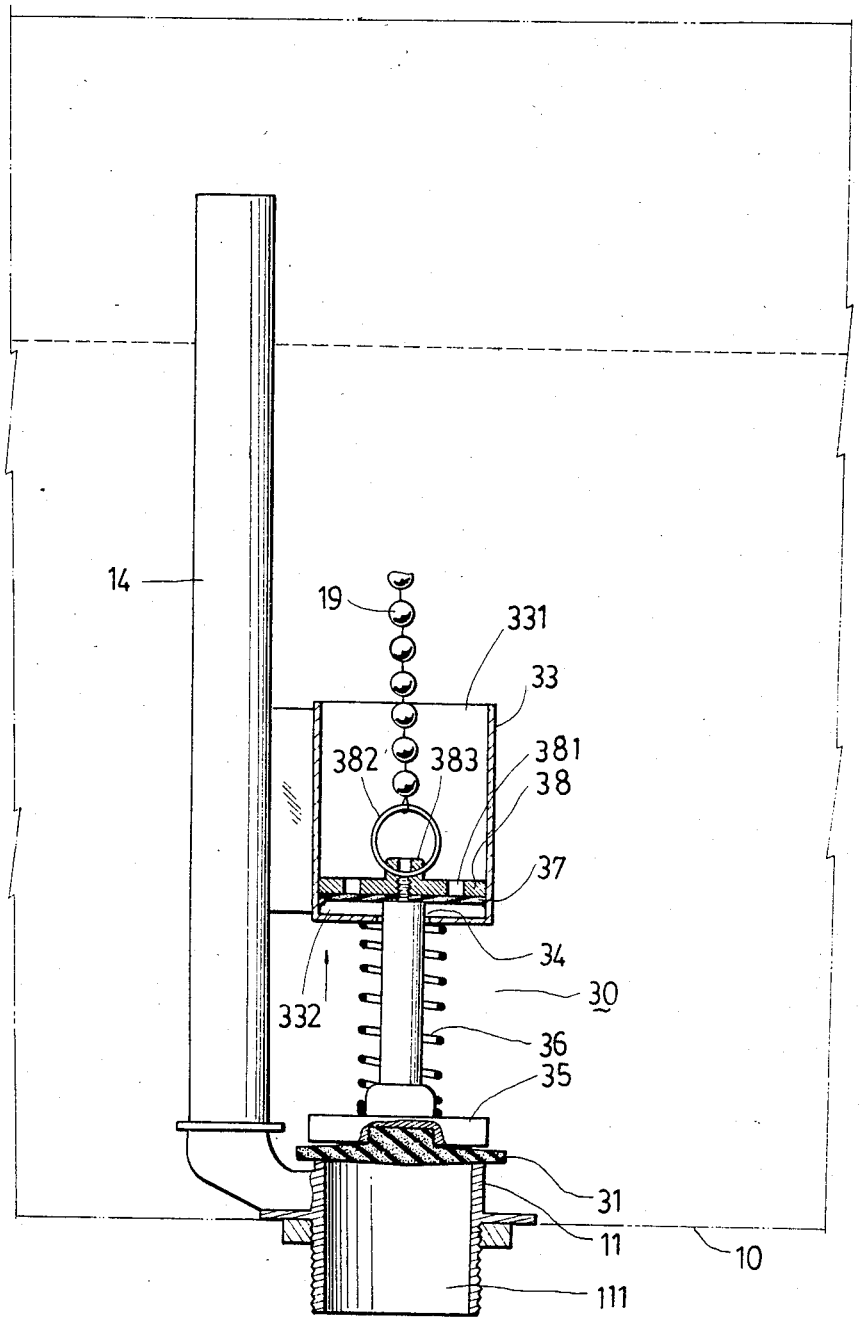
FIG. 3 is a fragmentary side view, with a portion shown in section, showing an embodiment of the water closet according to this invention in the closed position.
Figure 5:
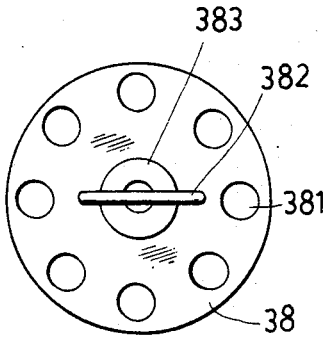
FIG. 5 is a top view of the pistion rod.

Referring now to FIG. 3, only the improved portion of the flushing device is shown therein, an upright post 14 is mounted on the bottom of the tank 10, a cylinder 33 is secured by integrally forming with the post 14 at an intermediate position thereof, a piston 38 is slidable in the cylinder 33, which is provided with a hub 383 to which a linking member 382 connected with a chain 19 or other equivalent means is fixed, there are a plurality of through holes 381 formed around the piston 38 at distance, as can be best seen in FIG. 5.

A piston rod 30 is connected with the piston 38, with one end thereof passed through an opening 34 formed on the bottom of the cylinder 33, the opening 34 is made with a diameter larger than the diameter of the piston 38 rod 38 thereby a clearence 371 is left for admitting the water to pass through under certain condition. On the underside of the piston 38, a rubber sealing plate 37 having a flange 371 is held between the piston 38 and the piston rod 30 at the center thereof, while the circumferential surface thereof is left flexible when a downward thrust is applied thereto. The piston rod 30 terminates in a cover 35 secured with a rubber sealing member 31 for sealing off the discharging end 111 of the flushing pipe 11. A compression spring 36 is held between the cylinder 33 and the cover 35 to bias the cover 35 away from the cylinder 33 when the tank 10 is in full water level as shown in FIG. 3. In such a position, the rubber sealing plate 37 is adhered to the piston 38 and prevents the water held in the upper chamber 331 above the piston 38 from flowing into the lower chamber 332 under the piston 38.

As soon as the operating lever (not shown) is pressed, the chain 19 and the linking member 382 will pull the piston rod 30 upwardly against the biassing of the compression spring 36, therefore, the cover 35 and the rubber sealing member 31 are moved away from the discharging end 111 to open that end, a flushing cycle thus is started.

Figure 4:
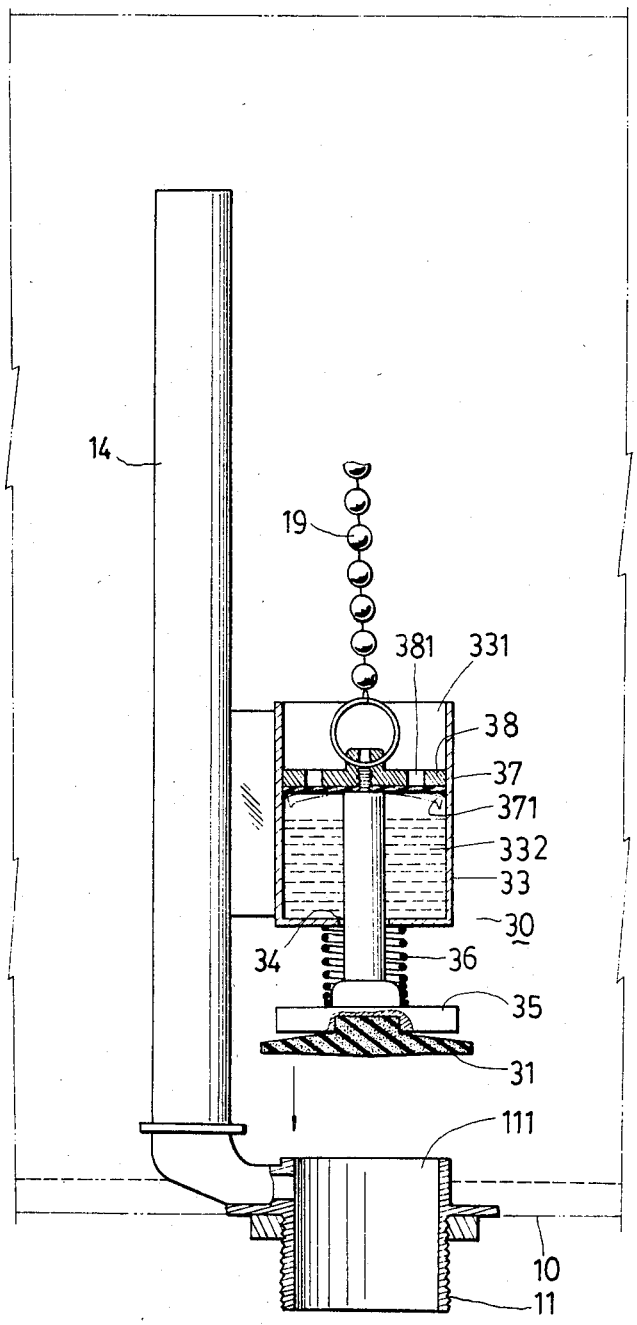
FIG. 4 is a similar view of FIG. 3 except that it is shown in the opened position.

When the piston 38 is moved against the water pressure applied thereon, under the action of the water pressure, the rubber sealing plate 38 flexes in an direction opposite to the movement of the piston 38 to form a substantial convex shape as illustrated in FIG. 4 by the phantom lines, in such condition, the water held in the upper chamber 331 above the piston 38 is admitted to the lower chamber 332 under the piston 38 at a controlled rate, the water contained in the lower chamber 332 under the piston 38 then will gradually flow to the tank 10 through the clearance 34 at a rather slow rate.

It can be understood from the illustration, that as soon as the lever is released, the compression spring 36 will return its normal position, however, the pressure of the water contained in the lower chamber 332 prevents the piston 38 from lowering suddenly until the water contained in the lower chamber 332 is lowered to such a level that the compression spring 36 predominates over the water pressure. It is also understood that the piston 38 is drawn downwardly to force the water out off the cylinder 33 under the action of the compressing spring 36.

The discharge in each cycle of flushing of the water closet is controllable by the piston displacement, the more the piston displacement, the more the water which is introduced into the lower chamber 332, therefore, it will take more time for the water to flow out of the cylinder 33 through the clearence 34, and therefore the lowering of the piston 38 will also take more time. On the contrary, the less the piston displacement, the less the water which is introduced into the lower chamber 332, therefore, it will take less time for the water to flow out of the cylinder 33 through the clearence 34, and less time for the lowering of the pistion 38.

Due to the action of the compression spring 36, the discharge cover 35 and the rubber sealing member will be held tightly against the discharging end 111 before flushing, in addition, it eliminates the drawback in the conventional structure that sometimes a clearence may be formed between the discharging end of the pipe and the rubber seal after a long time of usage.

While this invention has been described with what is presently considered to be the most practical and preferred embodiments, it is to be understood that the invention, is not to be limited to the disclosed embodiments, but on the contrary, is intended to cover various modifications and equivalent arrangements included within the spirit and scope of the appended claims which scope is to be accorded the broadest interpretation so as to encompass all such modifications and equivalent structures.

I claim:

1. A flush control device for the tank of a toilet including an inlet pipe and at the top thereof fitted with a flush valve the operation of which is controlled by a float, an operating lever having a portion thereof protruding outwardly from the tank and connected to a linking member having an end operatably secured with a discharge cover seated over a discharging pipe, the improvement comprises: a cylinder connected with said linking member, including an opened upper end disposed intermediate the high water level and the low water level of said tank, and a bottom wall provided with an opening; a piston being slidable in said cylinder and dividing the space within said cylinder into an upper chamber and a lower chamber having volumes which vary with the sliding thereof, said piston being provided with axial through holes for communicating said upper and lower chamber; a baffle means mounted beneath said piston and flexing downwardly as said piston is pulled upwardly against the water pressure, the water in said upper chamber thus is admitted downwardly to said lower chamber, said baffle limiting water flow in the opposite direction; a piston rod having an end passing through said opening of said cylinder to connect with said piston, said discharge cover being mounted on the opposite end of said piston rod for sealing off said discharging pipe; a compression spring mounted on said piston rod and biasing said discharge cover away from said cylinder, whereby said discharge cover is pulled away from said discharging pipe against the force of said compression spring, the water held in said tank will drain through said flushing pipe, and flow downwardly into said lower chamber to resist said compression spring returning to its extended position and said compression spring gradually returning to its extended position and biasing said discharge cover tightly against said discharging pipe once again.

2. A flush control device as claimed in claim 1, wherein the diameter of said opening of said cylinder is larger than that of said piston rod and a clearence is left between said piston rod and the wall which defines said opening.

3. A flush control device as claimed in claim 1, wherein said baffle means is an rubber plate having a peripheral surface contiguous to said cylinder .

* * * * *